US005695436A

United States Patent [19]

Huang

[11] Patent Number: 5,695,436

[45] Date of Patent: Dec. 9, 1997

[54] ABDOMEN FITNESS APPARATUS

[75] Inventor: Ming-Chih Huang, Tao Yuan, Taiwan

[73] Assignee: Ming-Chen Wang, Taipei, Taiwan

[21] Appl. No.: 695,892

[22] Filed: Aug. 12, 1996

[51] Int. Cl.[6] ..... A63B 21/02

[52] U.S. Cl. ..... 482/121; 482/125; 482/140; 482/908

[58] Field of Search ..... 482/44–46, 62, 482/92, 112, 114, 121–126, 129, 130, 139, 140, 148, 908

[56] References Cited

U.S. PATENT DOCUMENTS

| | | | |
|---|---|---|---|
| Re. 33,218 | 5/1990 | Twardosz | 482/139 |
| 4,517,966 | 5/1985 | von Othegraven | 482/125 |
| 4,625,963 | 12/1986 | Lancellotti | 482/44 |
| 5,378,217 | 1/1995 | D'Orta | 482/139 |

FOREIGN PATENT DOCUMENTS

| | | | |
|---|---|---|---|
| 30512 | 6/1981 | European Pat. Off. | 482/908 |
| WO 81/01662 | 6/1981 | WIPO | 482/112 |
| WO 94/09855 | 5/1994 | WIPO | 482/128 |

*Primary Examiner*—Jeanne M. Clark
*Attorney, Agent, or Firm*—Pro-Techtor International

[57] ABSTRACT

An abdomen fitness apparatus including a frame bar, a slide slidably mounted around the frame bar and having a longitudinal coupling hole and a transverse coupling hole, a bearing plate pivoted to the frame bar at one end and adapted for supporting on the user's body, a tubular end cap fixed to the frame bar at an opposite end, a connecting tube fastened to the transverse coupling hole of the slide; a plurality of elastic rubber bands connected between curved pegs at the tubular end cap and curved pegs at the slide, and two tubular handlebars respectively connected to two opposite ends of the connecting tube and adapted for pulling the connecting tube and the slide toward the bearing plate, and two spring-supported retainer rods mounted in a respective radial hole at two opposite ends of the connecting tube to position the handlebars in one of four equiangularly spaced angular positions respectively.

1 Claim, 10 Drawing Sheets

(PRIOR ART) FIG. 1

ABDOMEN FITNESS APPARATUS

BACKGROUND OF THE INVENTION

The present invention relates to an improved structure of abdomen fitness apparatus which is detachable, and can be conveniently adjusted to change the angular position of each of the two handlebars thereof separately.

FIG. 1 shows a conventional abdomen fitness apparatus which is commercially named as "MAGIC GUARD". This structure of abdomen fitness apparatus Comprises a base frame 1', a slide 2', a connecting tube 3', a handlebar 4', and a plurality of elastic rubber bands 5'. The base frame 1' comprises a rounded frame bar 12' having a bearing plate 11' fixedly disposed at one end, and a tubular end cap 13' fixedly secured to one end of the rounded frame bar 12' remote from the bearing plate 11'. The slide 2' is slidably mounted around the rounded frame bar 12' and moved between the tubular end cap 13' and the bearing plate 11'. The handlebar 4' is fixedly secured to the slide 2' at the top. The elastic rubber bands 5' are respectively connected between a curved pegs 131' at the tubular end cap 13' and a curved peg 22' at the slide 2'. Because the frame bar 12' has a rounded cross section, the slide 2' tends to be turned around the frame bar 12' when it is pulled toward the bearing plate 11', thereby causing the user unable to evenly apply the force to the handlebar 4'. Furthermore, because the handlebar 4' is fixedly secured to the slide 2', the angular position of two hand grips at two opposite ends of the handlebar 4' is not adjustable, and much transverse storage space is needed during the delivery of the apparatus.

SUMMARY OF THE INVENTION

The present invention has been accomplished to provide an abdomen fitness apparatus which eliminates the aforesaid drawbacks. According to one aspect of the present invention, the abdomen fitness apparatus comprises a frame bar having a first end and a second end, a slide mounted around and sliding along the frame bar, a bearing plate pivoted to the first end of the frame bar and adapted for supporting on the user's body, a tubular end cap fixed to the second end of the frame bar, a connecting tube fastened to the slide, a plurality of elastic rubber bands connected between the tubular end cap and the slide, and two tubular handlebars respectively connected to two opposite ends of the connecting tube and adapted for pulling the connecting tube and the slide toward the bearing plate, wherein the frame bar is not circular, and has at least one longitudinal plane surface along the length; the slide has a longitudinal coupling hole which fits and receives the non-circular frame bar. Therefore, the slide is prohibited from rotary motion relative to the frame bar. According to another aspect of the present invention, the tubular end cap has two curved pegs at two opposite sides, the slide has two curved pegs at two opposite sides respectively connected to the curved pegs of the tubular end cap by the elastic rubber bands. According to still another aspect of the present invention, two spring-supported retainer rods are mounted in a respective radial hole at the two opposite ends of the connecting tube to position the handlebars in one of four equiangularly spaced angular positions respectively. According to still another aspect of the present invention, the handlebars are respectively sleeved onto two opposite ends of the connecting tube and detachably secured in place by screws, and therefore the handlebars can be disconnected from the base frame to diminish storage space during the delivery of the apparatus.

DETAILED DESCRIPTION OF THE PREFERRED EMBODIMENT

Figure 1:
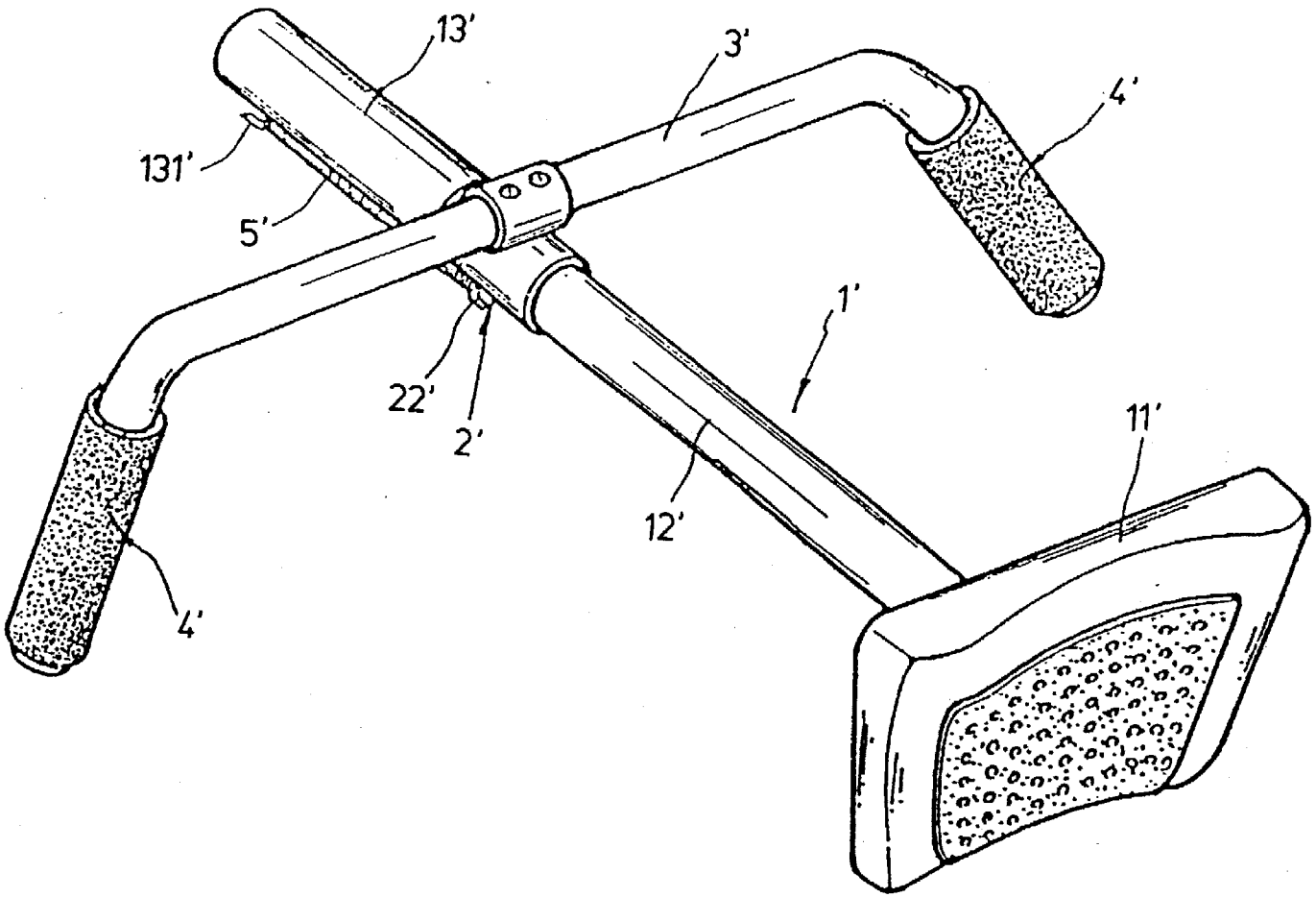
FIG. 1 is an elevational view of an abdomen fitness apparatus according to the prior art.
Figure 2:
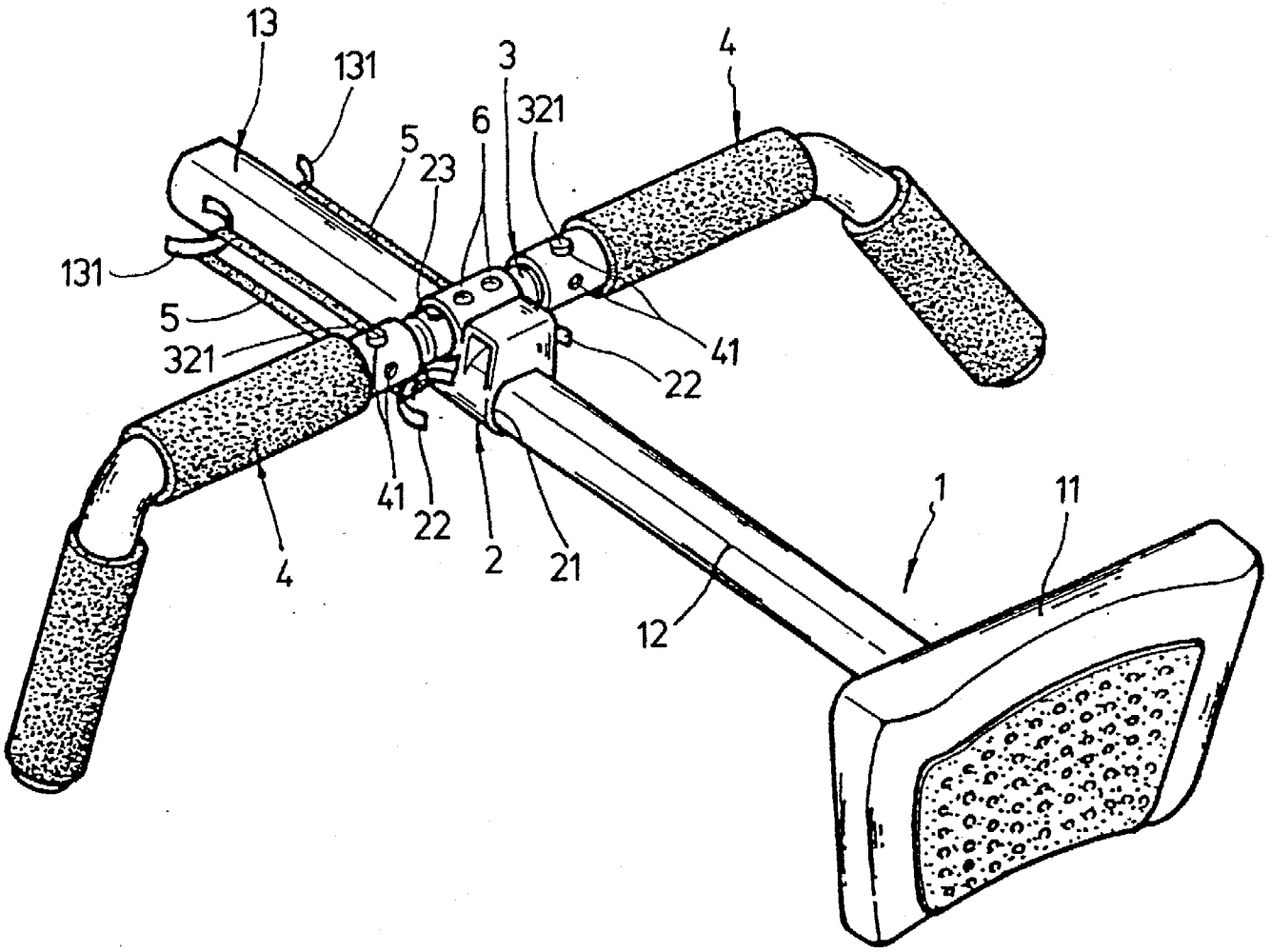
FIG. 2 is an elevational view of an abdomen fitness apparatus according to the present invention.
Figure 3:
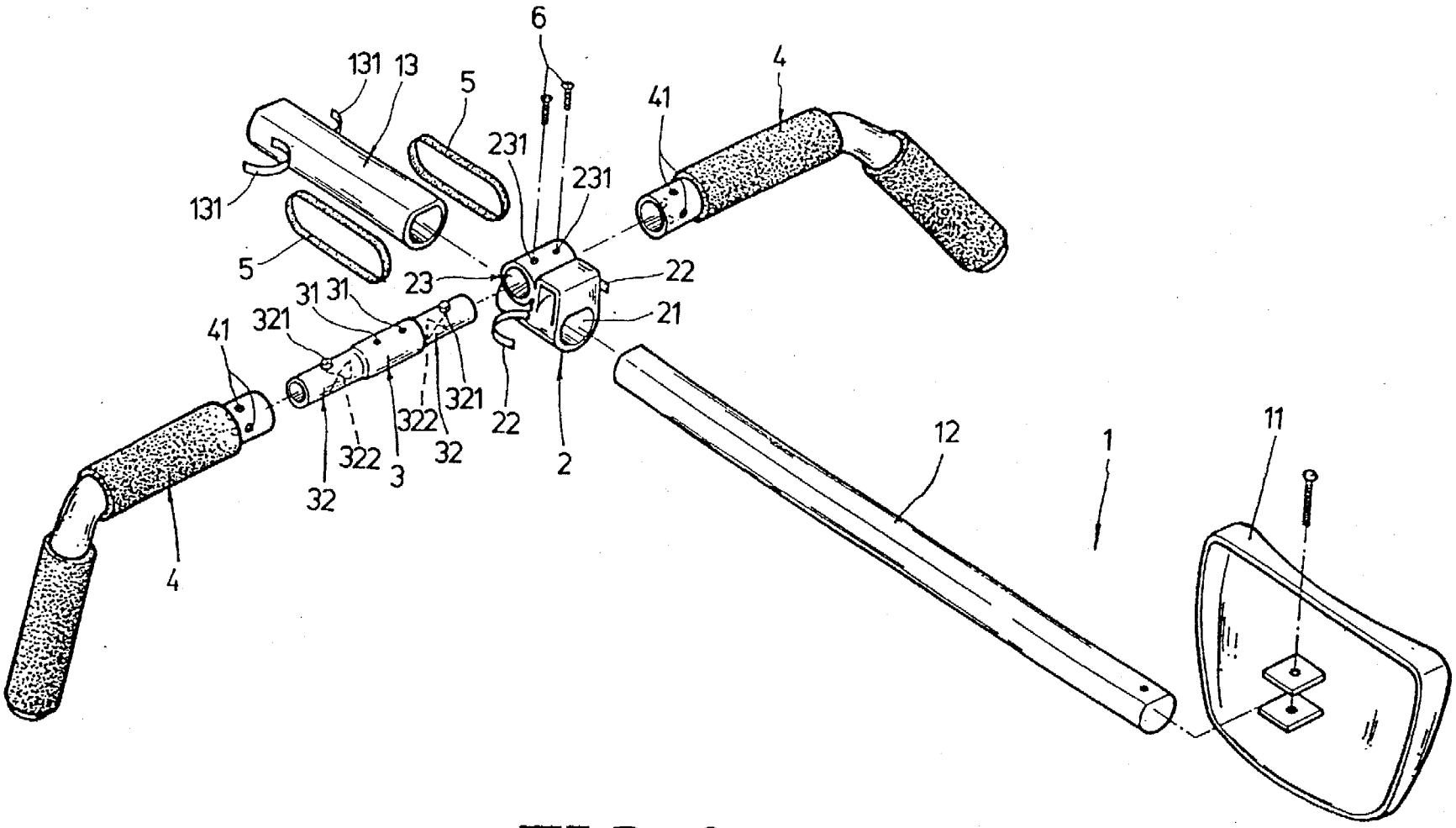
FIG. 3 is an exploded view of the abdomen fitness apparatus shown in FIG. 2.

Referring to Figures from 2 to 4, an abdomen fitness apparatus in accordance with the present invention is generally comprised of a base frame 1, a slide 2, a connecting tube 3, two tubular handlebars 4, and a plurality of elastic rubber bands 5.

The base frame 1 comprises a frame bar 12, a bearing plate 11 pivoted to one end of the frame bar 12 and adapted for stopping at the abdomen, and a tubular end cap 13 fixedly secured to an opposite end of the frame bar 12 remote from the bearing plate 11. The bearing plate 11 fits the abdomen. The tubular end cap 13 has two curved pegs 131 symmetrically raised from the periphery at two opposite sides.

The slide 2 is slidably mounted around the frame bar 12, comprising a longitudinal coupling hole 21 which receives the frame bar 12, two curved pegs 22 symmetrically disposed at two opposite sides and respectively connected to the curved pegs 131 of the tubular end cap 13 by the elastic rubber bands 5, a transverse coupling hole 23 disposed above the longitudinal coupling hole 21, and two mounting holes 231 respectively disposed in communication with the transverse coupling hole 23. Further, the frame bar 12 is not circular and preferably has a longitudinal plane surface or polygonal cross section, and the inner diameter of the longitudinal coupling hole 21 fits the outer diameter of the frame bar 12, so that the slide 2 is prohibited from rotary motion relative to the frame bar 12 when the frame bar 12 is inserted through the longitudinal coupling hole 21.

Figure 4:
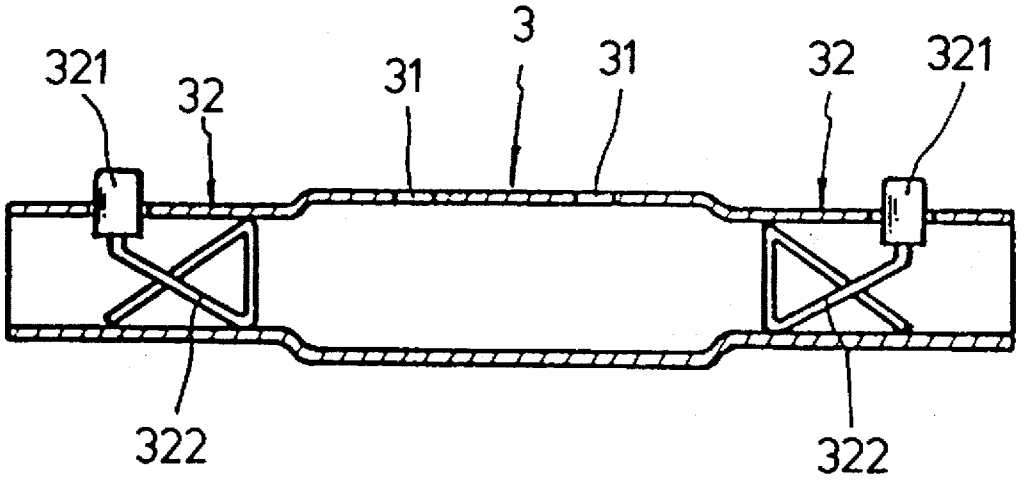
FIG. 4 is a longitudinal view in section in an enlarged scale of the connecting tube according to the present invention.
Figure 5:
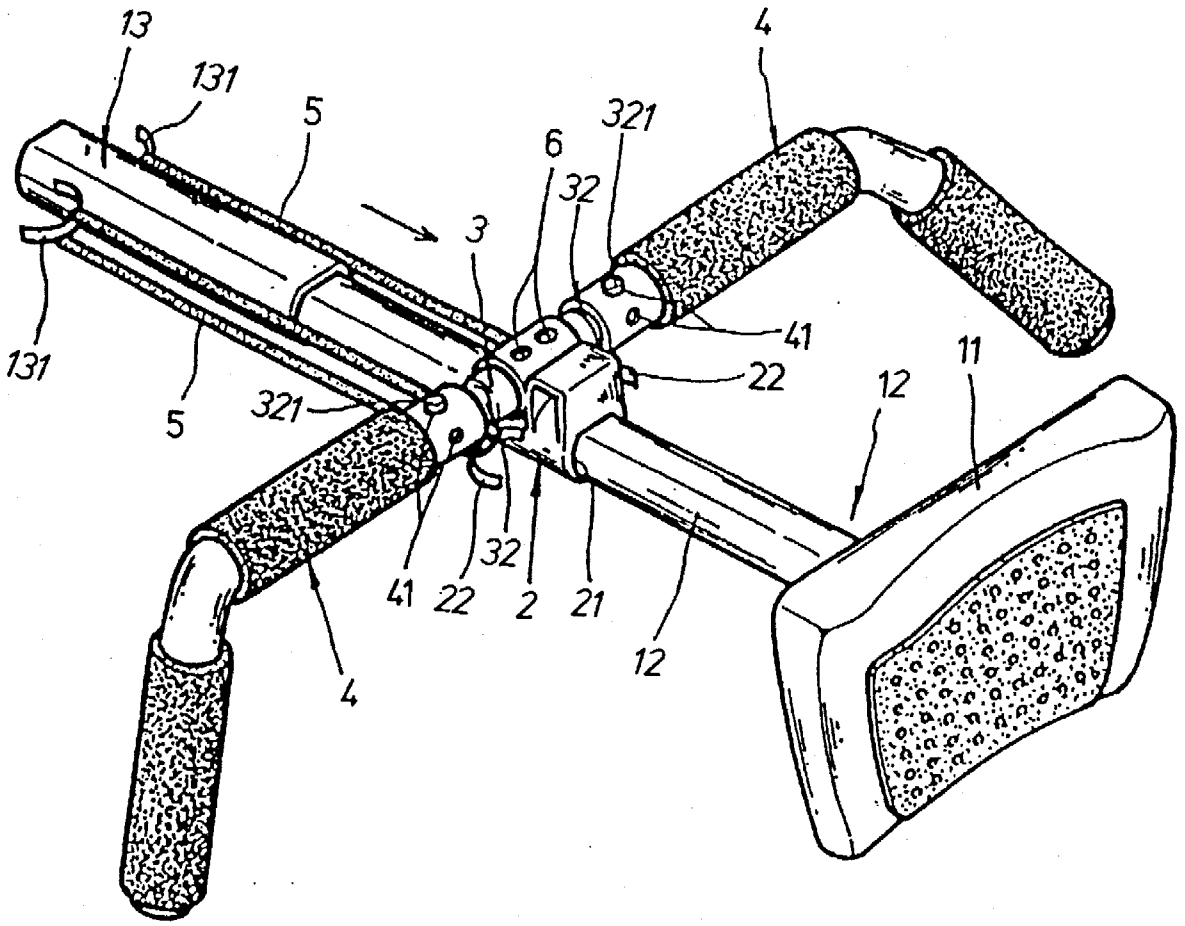
FIG. 5 is an applied view of the present invention, showing the handlebars pulled toward the bearing plate.
Figure 6:
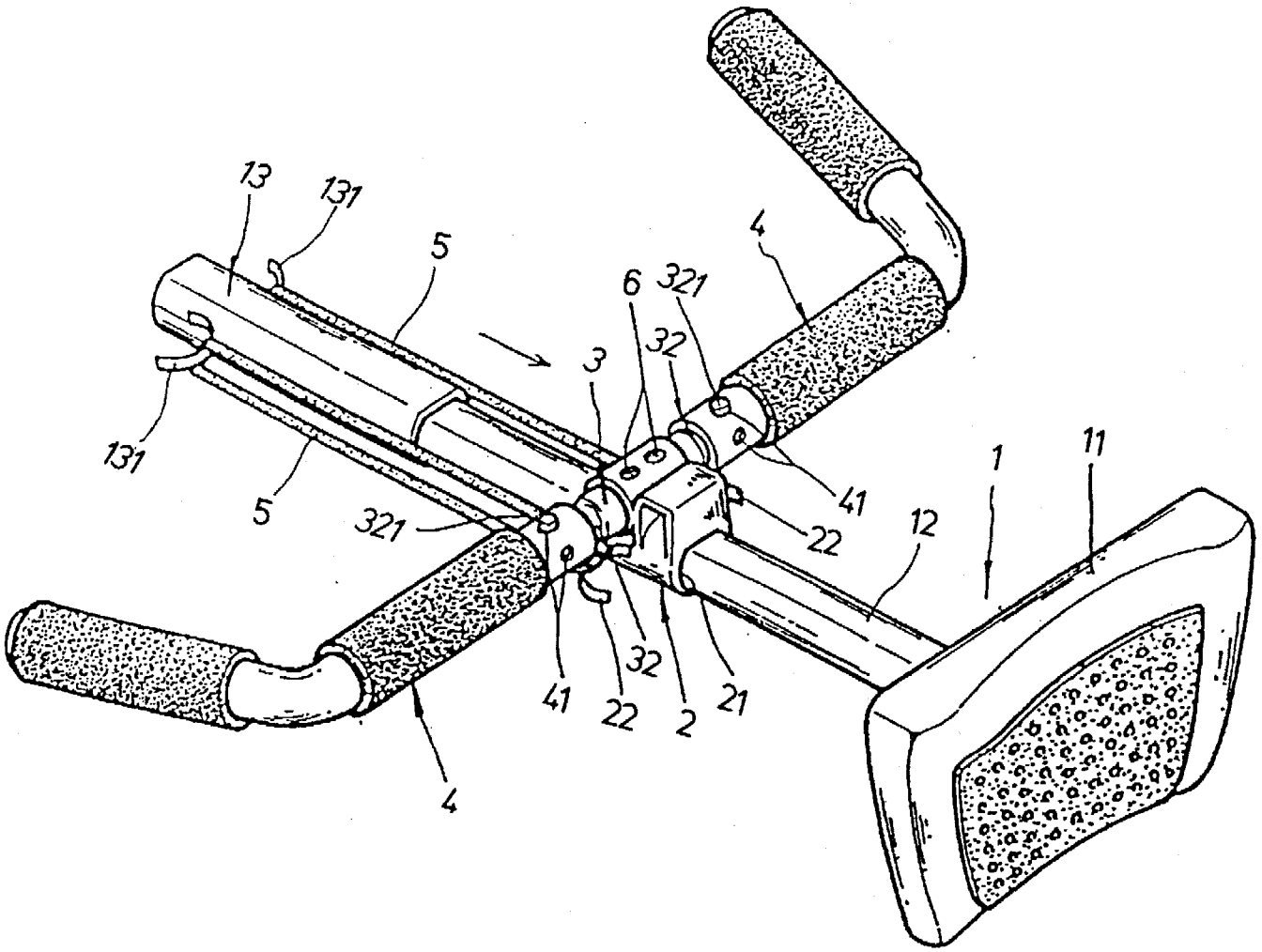
FIG. 6 is another applied view of the present invention, showing the handlebars set in a second position.
Figure 7:
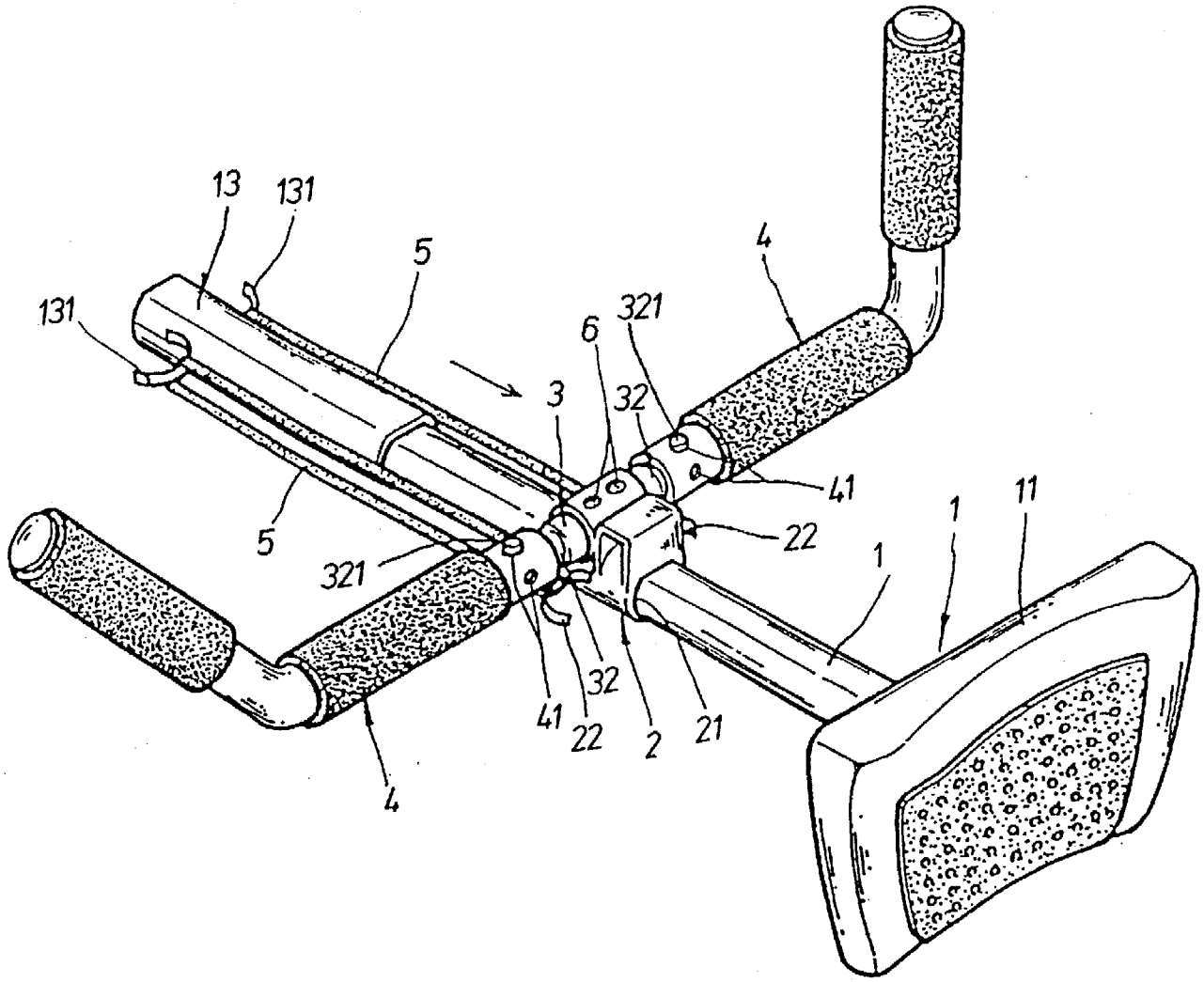
FIG. 7 is still another applied view of the present invention, showing the handlebars set in a third position.
Figure 8:
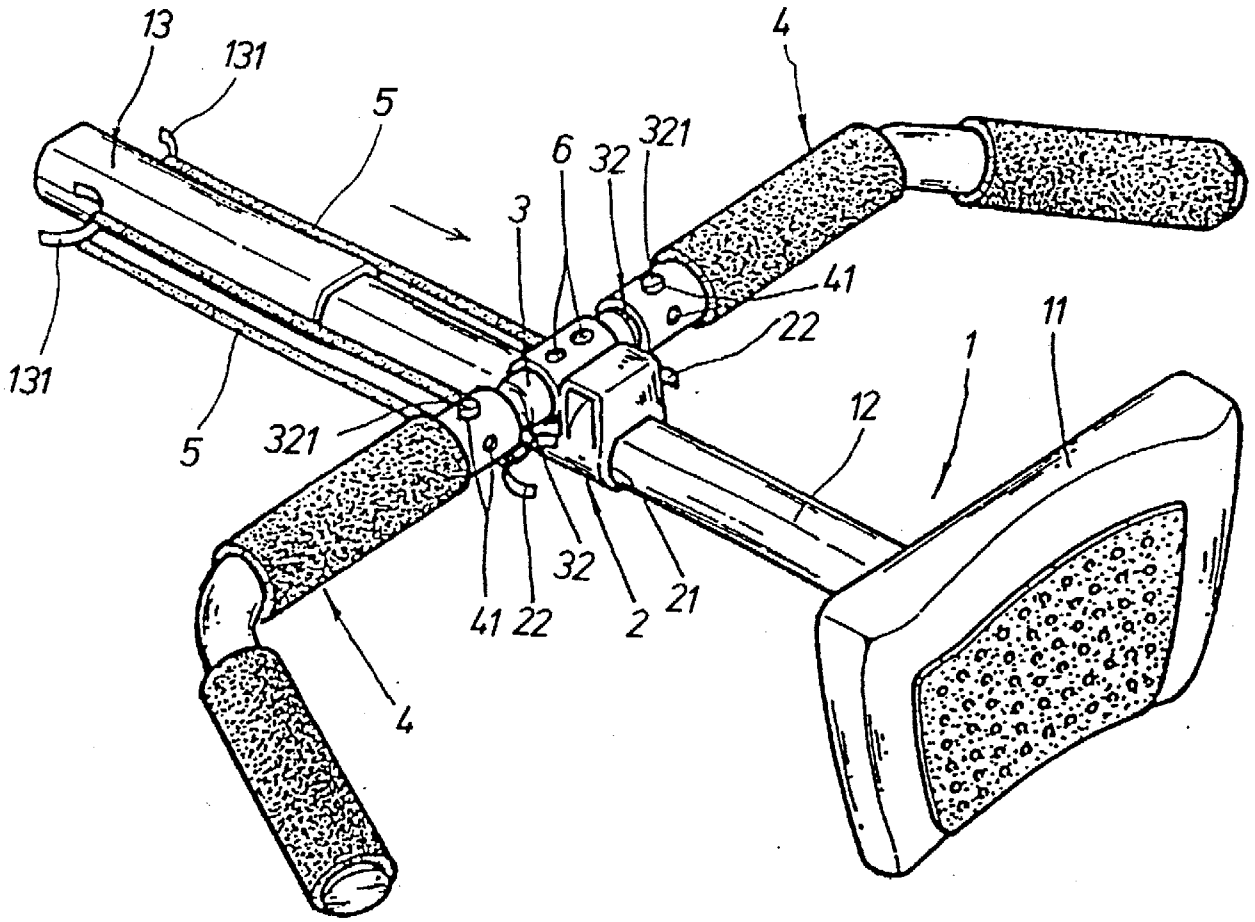
FIG. 8 is still another applied view of the present invention, showing the handlebars set in a fourth position.

The connecting tube 3 is inserted through the transverse coupling hole 23 of the slide 2, comprising two screw holes 31 in the middle respectively connected to the mounting holes 231 of the slide 2 by a respective screw 6, two extensions 32 at two opposite ends adapted for coupling to the tubular handlebars 4 respectively, two springs 322 respectively mounted in the extensions 32, and two retaining rods 321 respectively supported on the springs 322 and forced by the springs 322 out of a respective hole (not shown) in the extensions 32 (see FIG. 4).

The tubular handlebars 4 are respectively sleeved onto the extensions 32 of the connecting tube 3, and secured in place by the retaining rods 321. Each of the tubular handlebars 4 has four retaining holes 41 equiangularly spaced around the periphery near one end and adapted for receiving one retaining rod 321.

By changing the engagement between the retaining rods 321 and the retaining holes 41, the handlebars 4 can be set in any of the four angular positions shown in Figures from 5 to 8. When in use, the bearing plate 11 is stopped at the abdomen, and the handlebars 4 are pulled with the hands toward the bearing plate 11 to stretch the elastic rubber bands 5, and therefore the muscles of the hands and the abdomen are exercised.

Figure 9:
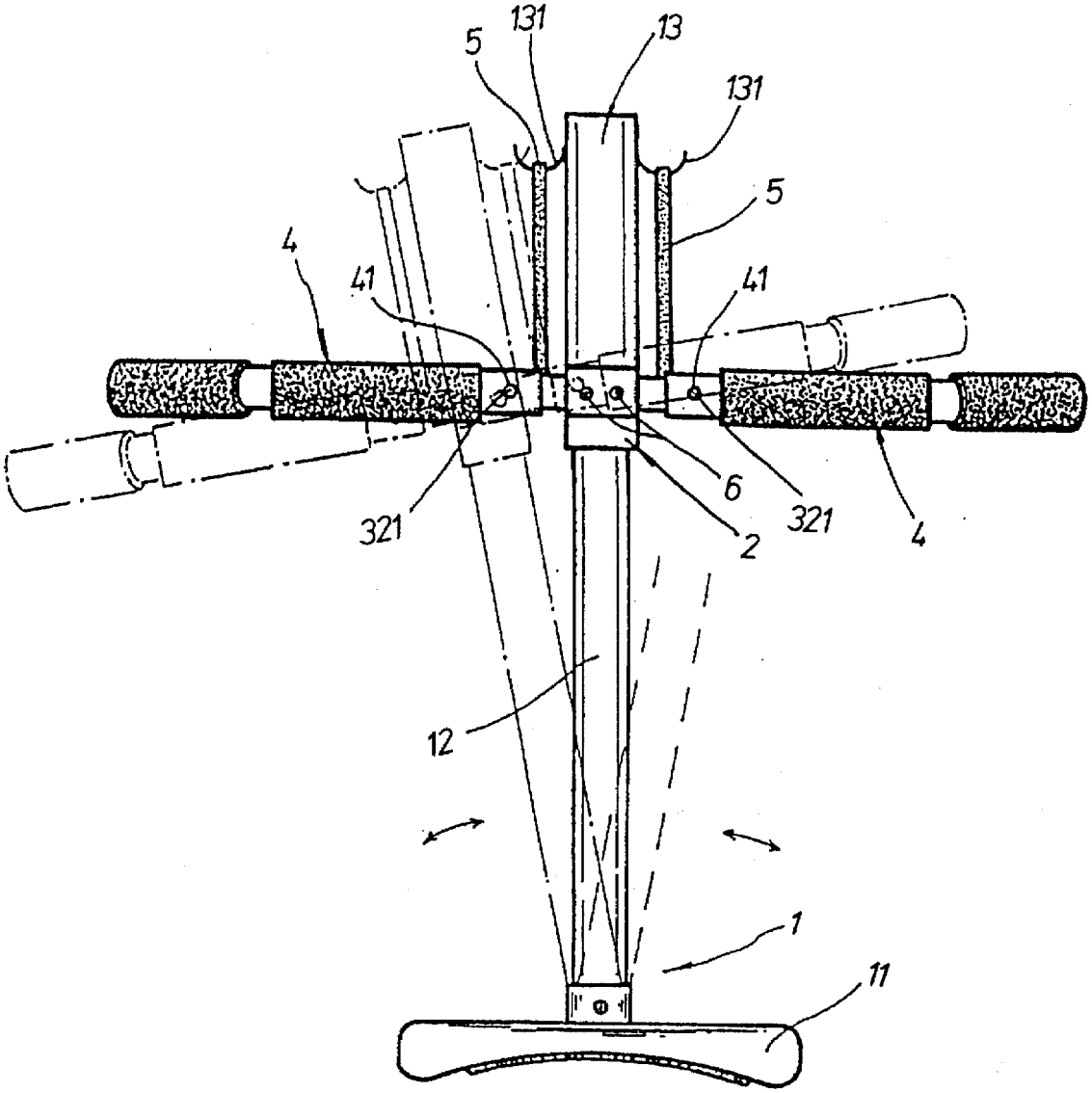
FIG. 9 is still another applied view of the present invention, showing the base frame oscillated relative to the bearing plate.

Referring to FIG. 9, because the bearing plate 11 is pivoted to the frame bar 12, the frame bar 12 can be turned leftwards and rightwards alternatively during exercising.

Figure 10:
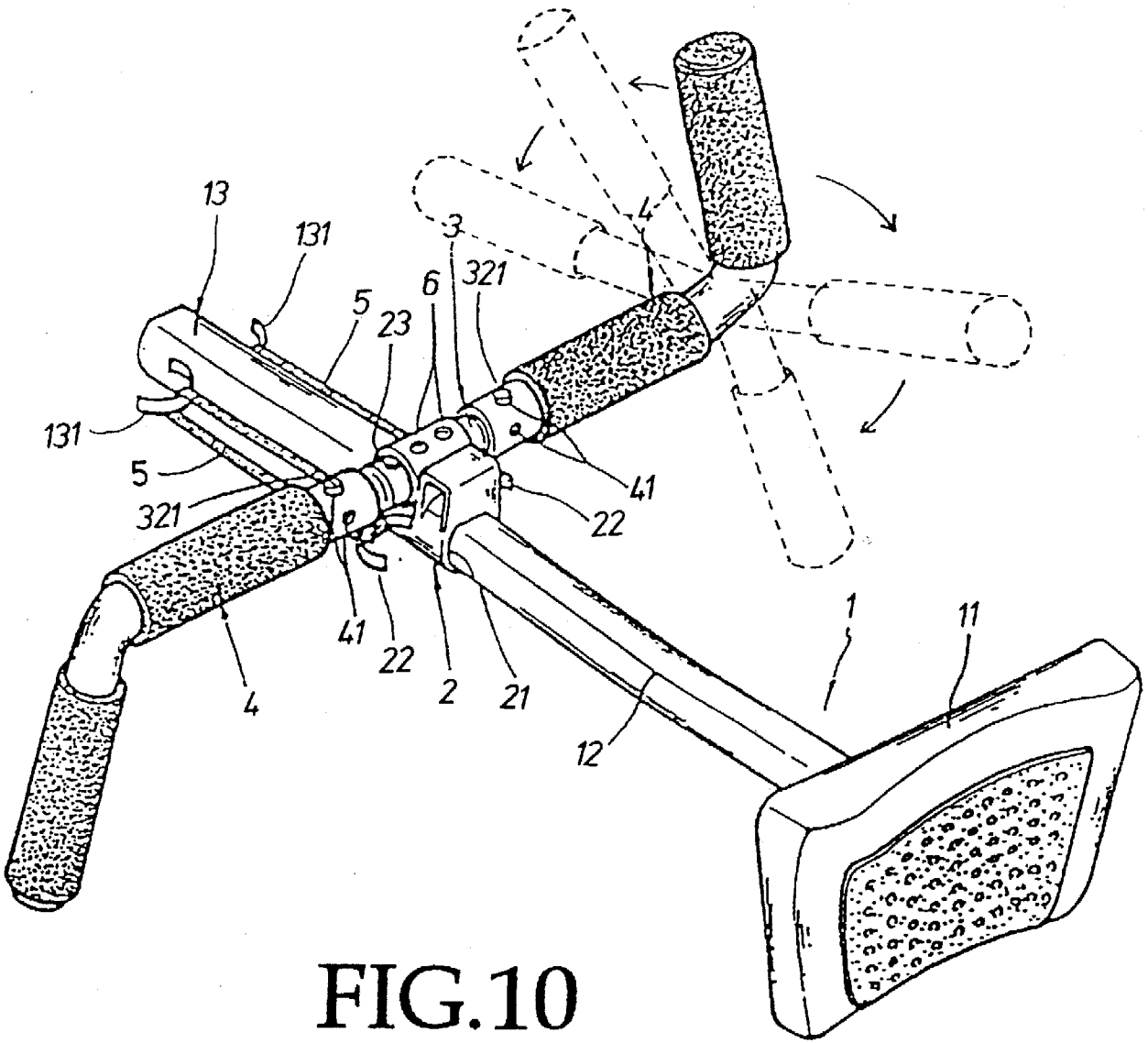
FIG. 10 is still another applied view of the present invention, showing the handlebars set in the reversed directions.

By changing the engagement between the retaining rods 321 and the retaining holes 41, the handlebars 4 can be set in the reversed direction as shown in FIG. 10, permitting the apparatus to be conveniently operated to exercise the muscles of the waist at one side.

While only one embodiment of the present invention has been shown and described, it will be understood that various modifications and changes could be made thereunto without departing from the spirit and scope of the invention disclosed.

What the invention claimed is:

1. An abdomen fitness apparatus comprising a frame bar having a first end and a second end, a slide mounted around and sliding along said frame bar, a bearing plate pivoted to the first end of said frame bar and adapted for stopping at the user's body, a tubular end cap fixed to the second end of said frame bar, a connecting tube fastened to said slide, a plurality of elastic rubber bands connected between said tubular end cap and said slide, and two tubular handlebars respectively connected to two opposite ends of said connecting tube and adapted for pulling said connecting tube and said slide toward said bearing plate, wherein:

said frame bar is not circular, and has at least one longitudinal plane surface along the length;

said tubular end cap has two curved pegs symmetrically raised from the periphery at two opposite sides for the mounting of said elastic rubber bands;

said slide comprises a longitudinal coupling hole which fits and receives said frame bar, two curved pegs symmetrically disposed at two opposite sides and respectively connected to the curved pegs of said tubular end cap by said elastic rubber bands, a transverse coupling hole which receives said connecting tube, and two mounting holes respectively disposed in communication with said transverse coupling hole;

said connecting tube is inserted through the transverse coupling hole of said slide and comprises two screw holes respectively connected to the mounting holes of said slide by a respective screw, two extensions respectively extending from two opposite ends thereof and disposed outside said slide and adapted for coupling to said tubular handlebars respectively, two springs respectively mounted inside said extensions, and two retaining rods respectively supported on said springs and forced by said springs out of a respective hole in said extensions for securing said tubular handlebars in place;

said tubular handlebars are respectively sleeved onto the extensions of said connecting tube, and secured in place by said retaining rods, each of said tubular handlebars having four retaining holes equiangularly spaced around the periphery near one end and adapted for engaging one retaining rod alternatively.

* * * * *